US010809013B2

(12) United States Patent
Cooper

(10) Patent No.: US 10,809,013 B2
(45) Date of Patent: Oct. 20, 2020

(54) HEAT EXCHANGE ELEMENT PROFILE WITH ENHANCED CLEANABILITY FEATURES

(71) Applicant: Howden UK Limited, Belfast (GB)

(72) Inventor: Jim Cooper, Strathclyde (GB)

(73) Assignee: Howden UK Limited, Belfast (GB)

( * ) Notice: Subject to any disclaimer, the term of this patent is extended or adjusted under 35 U.S.C. 154(b) by 947 days.

(21) Appl. No.: 15/022,692

(22) PCT Filed: Sep. 19, 2013

(86) PCT No.: PCT/GB2013/052451
§ 371 (c)(1),
(2) Date: Mar. 17, 2016

(87) PCT Pub. No.: WO2015/040353
PCT Pub. Date: Mar. 26, 2015

(65) Prior Publication Data
US 2016/0202004 A1 Jul. 14, 2016

(51) Int. Cl.
*F28D 19/04* (2006.01)
*F28F 3/02* (2006.01)
(Continued)

(52) U.S. Cl.
CPC ..... *F28D 19/044* (2013.01); *F28D 19/04* (2013.01); *F28F 3/025* (2013.01); *F28F 3/046* (2013.01);
(Continued)

(58) Field of Classification Search
CPC ..... F28D 19/044; F28D 19/04; F28F 3/025; F28F 3/046; F28F 3/08; F28F 13/08; F28F 19/00; F28F 2215/04; F28F 2245/08
(Continued)

(56) References Cited

U.S. PATENT DOCUMENTS 2,596,642 A * 5/1952 Boestad ..... F28D 19/042 165/10
3,661,203 A * 5/1972 Mesher ..... F28F 3/046 165/167
(Continued)

FOREIGN PATENT DOCUMENTS

CA 1125166 A2 6/1982
CA 1292425 C 11/1991
(Continued)

OTHER PUBLICATIONS

International Search Report and Written Opinion, dated Jun. 26, 2014 for PCT application, PCT/GB2013/052451 filed Sep. 19, 2013.
(Continued)

*Primary Examiner* — Tho V Duong
*Assistant Examiner* — Raheena R Malik
(74) *Attorney, Agent, or Firm* — Edell, Shapiro & Finnan, LLC

(57) ABSTRACT

A stack of heating surface elements includes a first heating surface element (4) having first (10), second (12) and third (14) zones arranged sequentially along a primary gas flow direction (A). The first zone (10) includes a herringbone structure, the second zone (12) includes a flat structure, and the third zone (14) includes a plurality of corrugations extending in the primary gas flow direction (A). The corrugations have flat peak and trough regions. The stack also includes a second heating surface element (36), where the second heating surface element includes a plurality of corrugations extending in the primary gas flow direction (A).

20 Claims, 8 Drawing Sheets

(51) Int. Cl.

| | |
|---|---|
| ***F28F 13/08*** | (2006.01) |
| ***F28F 3/08*** | (2006.01) |
| ***F28F 19/00*** | (2006.01) |
| ***F28F 3/04*** | (2006.01) |

(52) U.S. Cl.
CPC ..... *F28F 3/08* (2013.01); *F28F 13/08* (2013.01); *F28F 19/00* (2013.01); *F28F 2215/04* (2013.01); *F28F 2245/08* (2013.01)

(58) Field of Classification Search
USPC ..... 165/4
See application file for complete search history.

(56) References Cited

U.S. PATENT DOCUMENTS

| | | | | | |
|---|---|---|---|---|---|
| 4,061,183 | A * | 12/1977 | Davis | F28D 19/042 | 165/10 |
| 4,337,216 | A | 6/1982 | Korsell | | |
| 4,449,573 | A * | 5/1984 | Pettersson | F28D 17/02 | 165/10 |
| 4,548,766 | A * | 10/1985 | Kinney, Jr. | F28C 1/04 | 261/112.2 |
| 4,801,410 | A * | 1/1989 | Kinney, Jr. | F28F 25/087 | 261/112.2 |
| 4,911,235 | A | 3/1990 | Andersson et al. | | |
| 5,836,379 | A * | 11/1998 | Counterman | F28D 19/044 | 165/10 |
| 6,019,160 | A * | 2/2000 | Chen | F28D 19/044 | 165/10 |
| 6,098,706 | A * | 8/2000 | Urch | F28D 9/0025 | 165/153 |
| 6,145,582 | A * | 11/2000 | Bolle | F28D 19/041 | 122/1 A |
| 6,260,830 | B1 * | 7/2001 | Harrison | F28C 1/04 | 261/112.2 |
| 6,460,832 | B1 * | 10/2002 | Mockry | B01J 19/32 | 261/112.1 |
| 6,869,066 | B2 * | 3/2005 | Koo | F28F 25/087 | 261/112.2 |
| 6,938,885 | B2 * | 9/2005 | Koo | F28C 1/06 | 261/112.2 |
| 7,044,206 | B2 * | 5/2006 | Sabin | F28D 9/0037 | 165/166 |
| 8,684,071 | B2 * | 4/2014 | Andersson | F28F 3/046 | 165/167 |
| 9,557,119 | B2 | 1/2017 | Birmingham | | |
| 9,644,899 | B2 * | 5/2017 | Cowburn | F28D 19/044 | |
| 2002/0043362 | A1 * | 4/2002 | Wilson | F28D 9/0068 | 165/166 |
| 2003/0024697 | A1 * | 2/2003 | Matsuzaki | B21D 53/04 | 165/166 |
| 2009/0285956 | A1 * | 11/2009 | Landers | F28D 9/0037 | 426/477 |
| 2010/0218927 | A1 * | 9/2010 | Cooper | F28D 19/042 | 165/185 |
| 2010/0282437 | A1 * | 11/2010 | Birmingham | F28D 19/044 | 165/67 |
| 2011/0120687 | A1 * | 5/2011 | Nilsson | F01N 3/2821 | 165/177 |
| 2012/0305217 | A1 * | 12/2012 | Cowburn | F28D 19/044 | 165/67 |

FOREIGN PATENT DOCUMENTS

| | | | |
|---|---|---|---|
| CN | 88100674 | A | 9/1988 |
| CN | 101120223 | A | 2/2008 |
| CN | 102985780 | A | 3/2013 |
| EP | 1070928 | A1 | 1/2001 |
| JP | H06-109394 | A | 4/1994 |
| JP | 2000346583 | A | 12/2000 |
| JP | 200493036 | A | 3/2004 |
| WO | 93/25860 | | 12/1993 |
| WO | 99/19055 | A1 | 4/1999 |
| WO | 2007/012874 | A1 | 2/2007 |
| WO | 2010/129092 | A1 | 11/2010 |
| WO | 2011/133087 | A1 | 10/2011 |

OTHER PUBLICATIONS

Second Office Action from Chinese Patent Office for Chinese Application for Invention No. 201380007999.5 dated Apr. 7, 2017 with English summary, 5 pages.

First Office Action from Chinese Patent Office for Chinese Application for Invention No. 201710694144.5 dated Dec. 24, 2018 with English summary, 7 pages.

Second Office Action from Chinese Patent Office for Chinese Application for Invention No. 201380007999.5 dated Sep. 5, 2016 with English translation, 14 pages.

Examination Report for Indian Application No. 201617011899 dated Jun. 4, 2020 (6 pages).

* cited by examiner

HEAT EXCHANGE ELEMENT PROFILE WITH ENHANCED CLEANABILITY FEATURES

BACKGROUND OF THE INVENTION

Field of the Invention

Embodiments of the invention generally relate to heat exchange element profiles, and more particularly to improved heat exchange element profiles for use in rotary regenerative heat exchangers, where the profiles have enhanced cleanability.

Discussion of Related Art

In order to be competitive in today's market, heat transfer elements used in rotary regenerative heat exchangers in coal or oil fired plants must combine high thermal performance with low pressure drop. At the same time, these heat transfer elements must have as low fouling potential as possible towards the extreme cold end of the element profile where heat transfer, acid condensation and, consequently, associated solids deposition rates are at a maximum.

For optimum operation, it is also important that heat transfer elements avoid potentially equally problematic fouling conditions further up the air preheater where, depending on the element arrangement, localized element metal temperatures may be almost as low as at the extreme cold end of the preheater. Moreover, selective catalytic reduction (SCR) processes for the reduction of nitrous and nitric oxides (NOx) produce the additional risk of ammonium bisulphate (ABS) fouling, which can occur at noticeably higher temperatures occurring further up the air preheater in the zone that is normally occupied by the intermediate or hot end tier of elements. These heat transfer elements generally have higher performance characteristics as is necessary to achieve the required overall thermal performance of the air preheater.

Techniques for cleaning these heat transfer elements include the use of sootblowing devices that employ high energy cleaning jets consisting of pressurized steam or compressed air. The effectiveness of such devices in cleaning areas further up the heat exchange elements is greatly hampered by the loss in energy and impact velocity of the cleaning jets that naturally occurs over the inter-tier gap that inevitably exists between the cold end and intermediate tiers of heat exchange elements. Hence, under such circumstances, severe fouling can occur further up the heater due to ABS fouling or the condensation of other species having a relatively high temperature dewpoint.

In the past, it has been traditional for many air preheater suppliers to provide a shallow cold end tier of low-performance. notched-flat (NF) elements as shown in FIG. 8 from WO2007/012874. In these cases, both intermediate and hot end element tiers that are manufactured from higher performance corrugated undulated elements such as shown in FIG. 6 or any of the alternative high performance elements shown in FIGS. 1-7 or FIGS. 9-10 of WO2007/012874.

As an alternative approach, the transverse herringbone sheets shown in FIGS. 11-15 of WO2007/012874 produce high performance element profiles that are arguably much more cleanable than any of the other high performance elements, with this higher cleanability allowing them to be used at lower cold end temperatures before the element fouling becomes uncontrollable. When used for the cold end elements, these improvements were believed to be sufficient to allow such elements to be successfully used to operate down to similar gas outlet temperatures as notched flat elements while avoiding uncontrollable fouling.

By the use of deep tiers of such elements, therefore, it has been proposed that such an element with the same profile throughout its full depth would be suitable to control a combination of cold end acid enhanced fouling and ABS enhanced fouling further up the elements. Unfortunately, while the common use of low performance, notched flat elements can be expected to reduce the extreme cold end fouling rate, this same low thermal performance tends also to drive the acid condensation temperature band higher into the elements with the possibility of it extending into the cold end of the intermediate element tier, where the localized element temperatures can approach the extreme cold end element temperature. As these intermediate tiers are only reached after the inter-tier gap, the associated reduction in sootblowing jet velocities results in a great loss in their cleaning effectiveness. Consequently, there are many instances in which, while the cold end element tier can be adequately cleaned, the most extreme fouling has been proven to occur at entry to the intermediate tier. This uncontrollable fouling ultimately limits the availability of the air preheater as the associated increase in pressure drop can become too large for the induced draft fans to accommodate without throttling back in flow rate.

In view of the above, it would be desirable to provide an improved heat exchange element that is designed to better address both cold end fouling problems and intermediate fouling problems occurring due to ABS formation further up the air preheater.

SUMMARY OF THE DISCLOSURE

To solve the aforementioned problem, the inventor has incorporated two different forms of profile into a single heat transfer element. In one embodiment a very low performing profile (but equally low fouling profile) is disposed at the extreme cold end of the heat transfer element sheet, while a higher performance profile is disposed towards the hot end of the heat transfer element sheet.

The low performance cold end of the heat transfer element can serve to limit the amount of heat transfer in that area and hence the associated temperature swing and minimum temperature of these heat transfer elements during each revolution of the air preheater. For this reason, the fouling rate at the extreme cold end of the air preheater rotor is expected to be lower with such low performance heat transfer elements compared to any higher performance heat transfer element.

Because there can be a different profile at each end of the element sheet, a narrow transition zone can be provided between the differing profiles to enable smooth surface transition between the low and high performance zones and also to ensure the continuity of sootblowing jets through the transition zone.

A stack of heat transfer elements is disclosed. The stack can have a primary direction and can include first and second heat transfer elements. The first heat transfer element can include first, second and third zones arranged sequentially along the primary direction. The first zone may include a herringbone structure comprising a plurality of undulations arranged laterally side by side. The longitudinal extent of the undulations can be non-parallel to the primary direction. The second zone may include a flat structure. The third zone may include a plurality of corrugations extending in the primary direction. The corrugations may have a plurality of flat peaks and troughs. The second heat transfer element may include a plurality of corrugations extending in the primary direction.

A stack of heating surface elements is disclosed. The stack may have a primary direction. The stack may include a first heating surface element having first, second and third zones arranged sequentially along the primary direction. The first zone may include a herringbone structure. The herringbone structure may include a plurality of regions. The plurality of regions may be arranged such that the boundary of regions is along said primary direction. The plurality of regions may include a first region having a plurality of undulations arranged laterally side by side, the longitudinal extent of the undulations in said first region being greater than 0° and less than 90° to the primary direction. The plurality of regions may further include a second region adjacent to said first region. The second region may have a plurality of undulations arranged laterally side by side, the longitudinal extent of the undulations in said second region may be less than 0° and more than −90° to the primary direction. The second zone may include a flat structure. The third zone may include a plurality of corrugations extending in the primary direction, the corrugations having flat peak and trough regions. The stack may further include a second heating surface element. The second heating surface element may include a plurality of corrugations extending in the primary direction.

A stack of heating surface elements is disclosed. The stack of surface elements may include a primary direction. The stack may comprise a first heating surface element having first, second and third zones arranged sequentially along the primary direction. The first zone may comprise a herringbone structure, the second zone may comprise a flat structure, and the third zone may comprise a plurality of corrugations extending in the primary direction. The corrugations may have flat peak and trough regions. The stack may further include a second heating surface element. The second heating surface element may include a plurality of corrugations extending in the primary direction.

BRIEF DESCRIPTION OF THE DRAWINGS

The accompanying drawings illustrate preferred embodiments of the disclosed method so far devised for the practical application of the principles thereof, and in which.

DESCRIPTION OF EMBODIMENTS

An improved heat transfer element profile is disclosed. The disclosed heat transfer element profile comprises a composite element profile having a first profile at a hot end of the element and a second profile at a cold end of the element. In one embodiment, the heat transfer element profile includes a transverse herringbone element towards the hot end of the deep undulated element and a notched flat profile towards the cold end of the profile.

Figure 1:
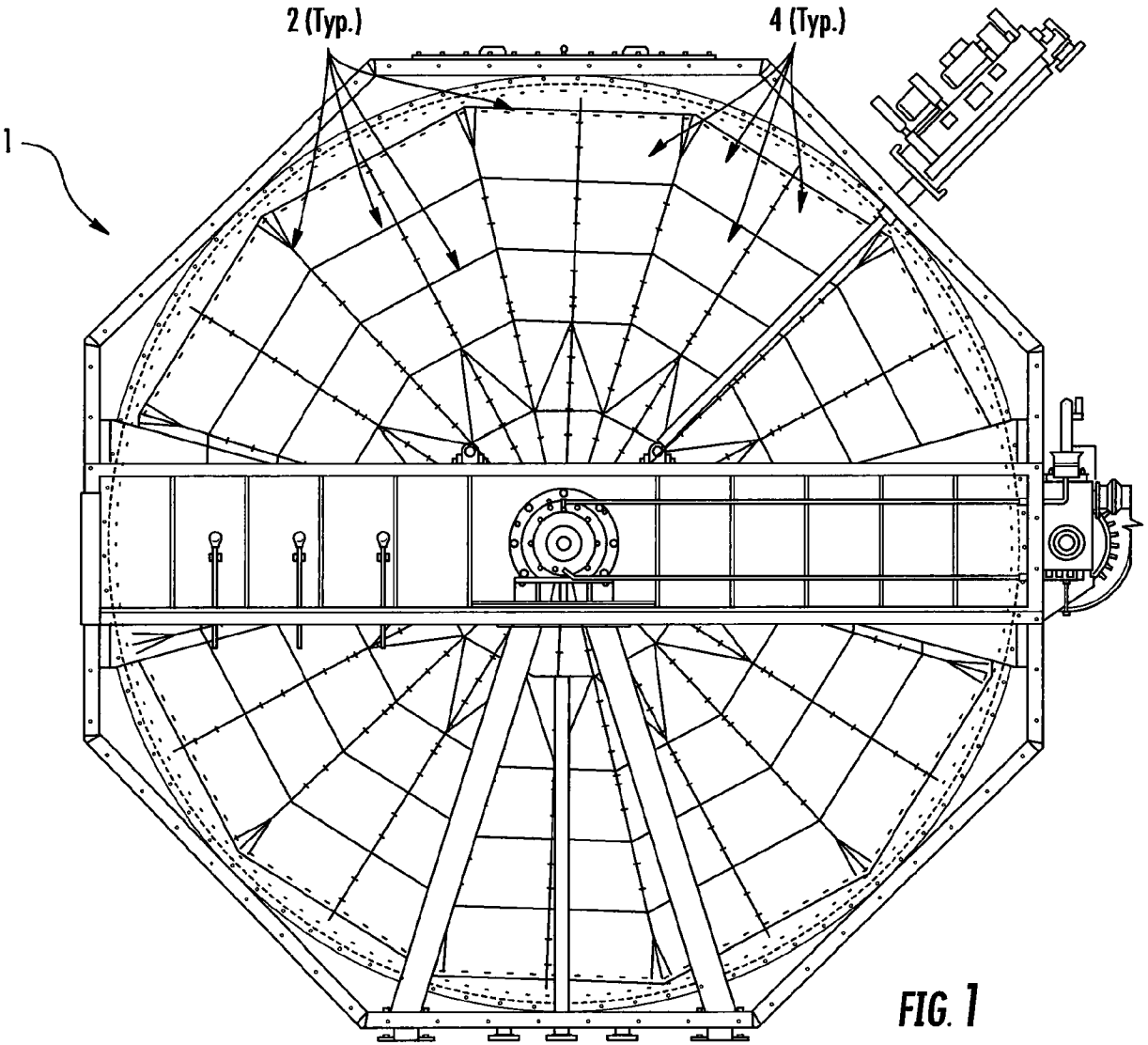
FIG. 1 is a top plan view of an exemplary preheater assembly incorporating the disclosed heat transfer elements.

FIG. 1 is a top view of an exemplary preheater 1 including a plurality of individual heater baskets 2, each of which can include a plurality of heat transfer elements 4. In the illustrated embodiment the "hot" end of the heat transfer elements 4 are visible. The "cold" end of the heat transfer elements 4 are positioned on the opposite side of the preheater.

Figure 2:
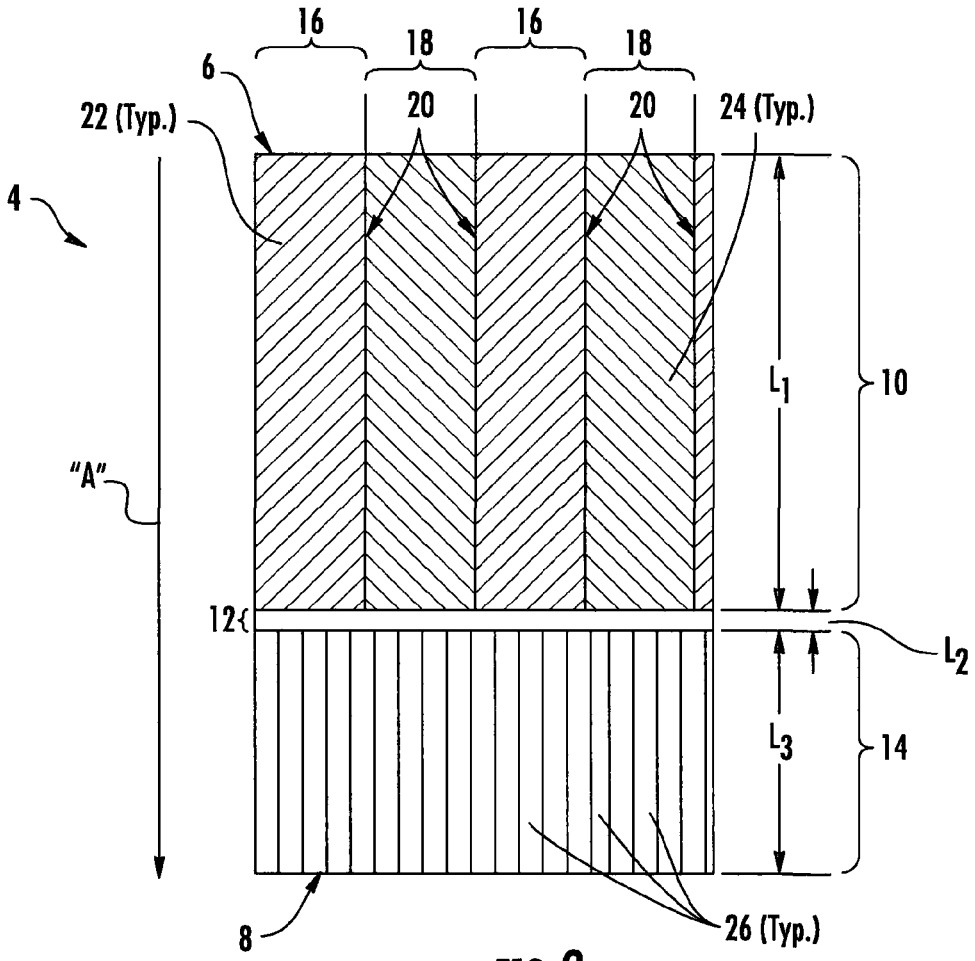
FIG. 2 is a plan view of an exemplary heat transfer element according to the disclosure.

Referring now to FIG. 2, an exemplary first heat transfer element 4 is shown. The heat transfer element 4 may have first and second ends 6, 8, which may be referred to generally as "hot" and "cold" ends, respectively. The first heat transfer element 4 may include a plurality of discrete profile zones. In the illustrated embodiment first, second and third zones 10, 12, 14 are provided. The first zone 10 is disposed adjacent to the first ("hot") end 6 of the first heat transfer element 4. The third zone 14 is disposed adjacent to the second ("cold") end of the first heat transfer element 4. The second zone 12 serves as a transition zone, and thus is disposed between the first and third zones 10, 14. In use the heat transfer element 4 may have a primary gas flow direction identified by arrow "A" such that gas will generally flow from the first end 6 to the second end 8.

The first zone 10 comprises a herringbone profile. The herringbone profile can include a plurality of alternating first and second regions 16, 18. Each of the first and second regions 16, 18 can be arranged such that the boundary 20 between regions is oriented along the primary direction of gas flow "A." In the illustrated embodiment, the first region 16 includes a plurality of undulations 22 arranged laterally side by side, where the longitudinal axis "B-B" (FIG. 3) of the undulations in the first region 16 is oriented at an angle "$\alpha$" with respect to the primary direction of gas flow "A." In some embodiments, the angle "$\alpha$" is between about 0° and 90°. The second region 18 can be positioned adjacent to the first region 16, and can include a plurality of undulations 24 arranged laterally side by side, where the longitudinal axis "C-C" (FIG. 3) of the undulations 24 in the second region 18 may be oriented at an angle "$\beta$" with respect to the primary direction of gas flow "A." In some embodiments, the angle "$\beta$" is between about 0° and −90°. As can be seen, the first zone 10 may include a plurality of alternating first and second regions 16, 18.

Figure 3:
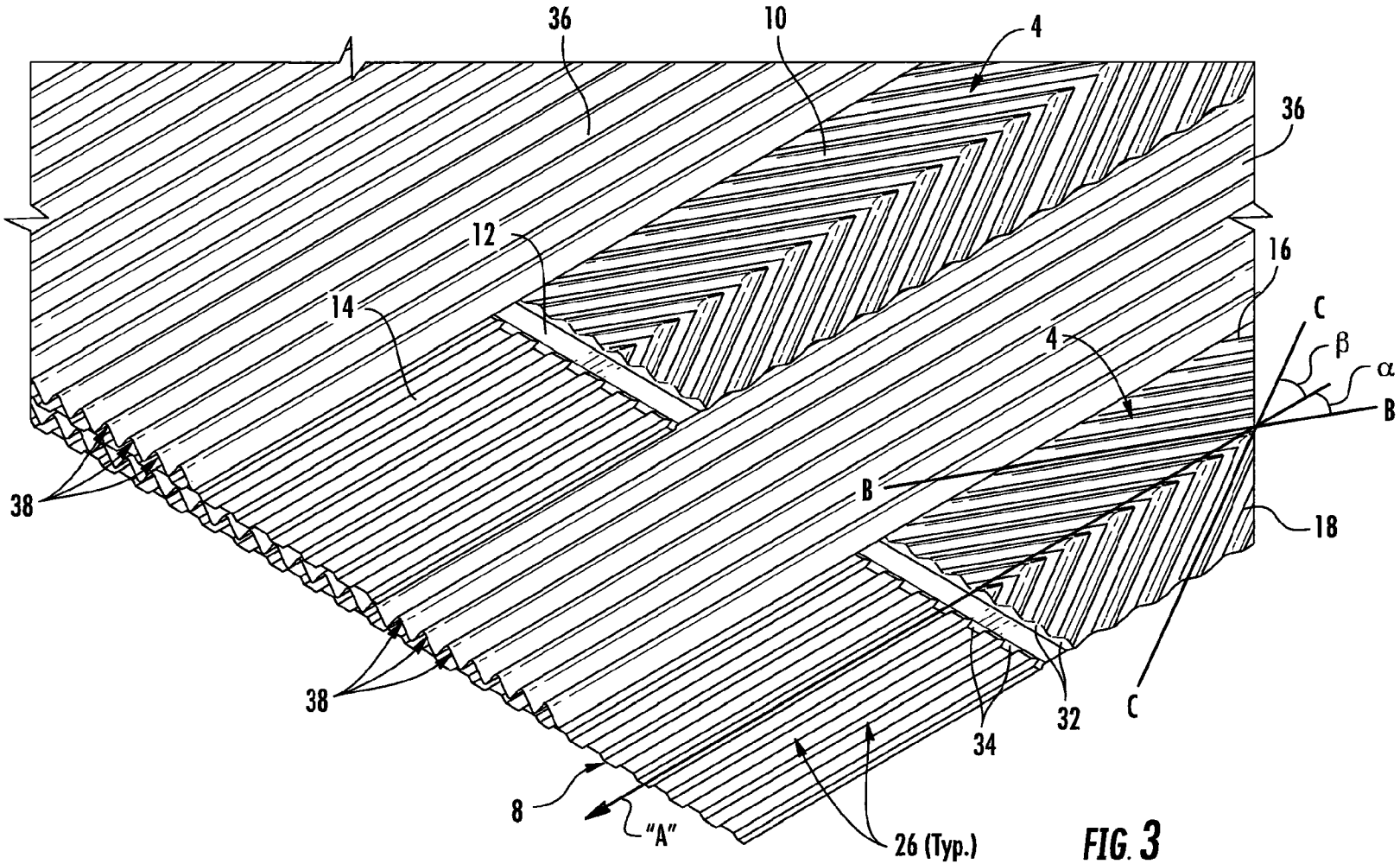
FIG. 3 is an isometric view of an exemplary stack of heat transfer elements including the heat transfer element of FIG. 2.
Figure 4:
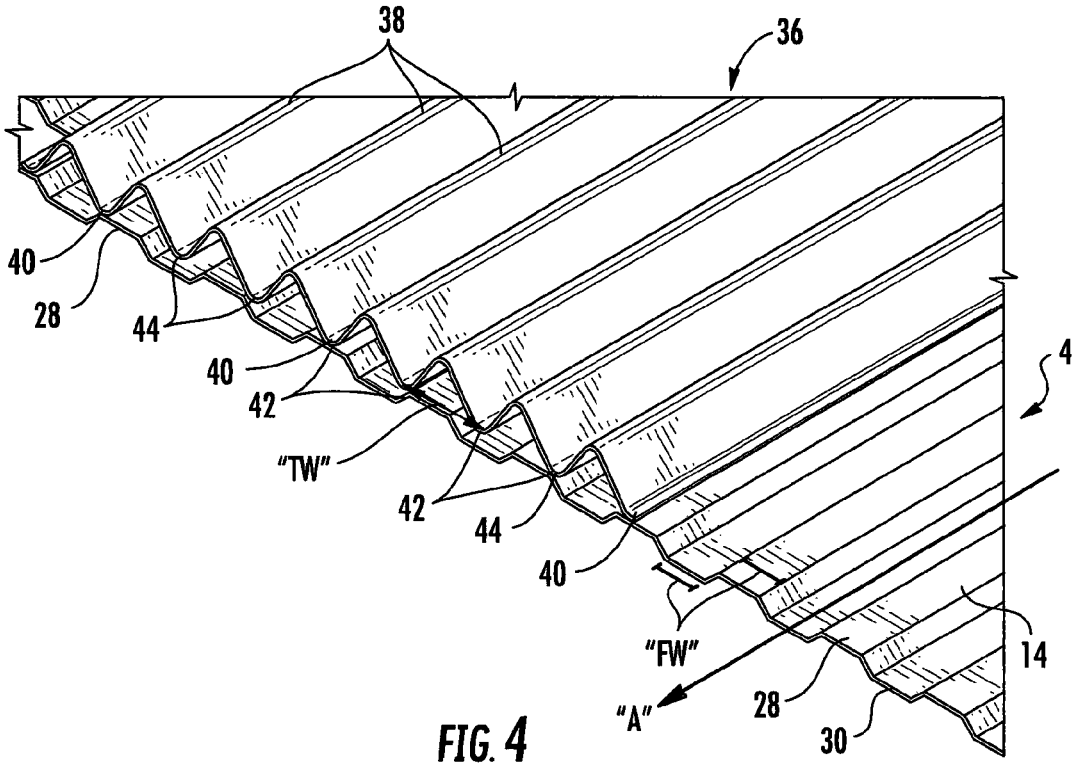
FIG. 4 is a detail isometric view of a portion of the stack of FIG. 3.

The third zone 14 can be a corrugated sheet in which the undulations 26 are oriented substantially parallel to the primary direction of gas flow "A." In the illustrated embodiment the undulations 26 have flat peaks 28 and troughs 30 (see FIGS. 3 and 4). Disposed between the first and third zones 10, 14 is a second zone 12 which may be referred to as a "transition" zone. The second zone 12 is a generally flat profile without undulations, as can best be seen in FIG. 3. The second zone 12 may include first and second transition regions 32, 34 that convert the shapes of the first and third zones 10, 14, respectively, to the flat profile of the second zone 12. Thus, these first and second transition regions serve to provide a smooth conversion of the profiles of the first and third zones 10, 14 to the flat profile of the second zone 12.

Referring again to FIG. 2, the first, second and third zones 10, 12, 14 may have respective lengths $L_1$, $L_2$, $L_3$. In some non-limiting exemplary embodiments, the length $L_1$ may be between 600 to 900 millimeters (mm), the length $L_2$ may be between 5 to 25 mm, and the length $L_3$ may be between 200 to 300 mm. It will be appreciated that these lengths are not critical, and that other lengths can be used.

Although the illustrated embodiment includes three discrete profile zones, it will be appreciated that the specific number of zones is not critical, and thus, the first heat transfer element 4 may have as few as two zones, or more than three zones.

FIG. 3 shows a stack of interposed first and second heat transfer elements 4, 36. It will be appreciated that the arrangement of FIG. 3 is for illustrative purposes, and that in practical application a typical heater basket 2 may include a large number of interposed first and second heat transfer elements. In the illustrated embodiment, the second heat transfer elements 36 include a corrugated profile having a plurality of undulations 38 oriented substantially parallel to the primary direction of gas flow "A."

FIG. 4 shows the interaction between a first heat transfer element 4 and an exemplary second heat transfer element 36 near the second end 8 (i.e., the "cold" end) of the stack. In this embodiment, the width "FW" of the flat peaks 28 and troughs 30 of the first heat transfer element 4 is about 0.5 times the distance "TW" between adjacent troughs 42 of the corrugations 38 of the second heat transfer element 36. As can be seen, in certain places 40, the troughs 42 of the second heat transfer element 36 have good line contact with the flat-topped peaks 28 and troughs 30 of the third zone 14 of the first heat transfer element 4. In other places 44, the troughs 40 of the second heat transfer element have poor or no line contact with the flat-topped peaks 28 and troughs 30 on the third zone 14 of the first heat transfer element 4. The interrelation between the features of the first and second heat transfer elements 4, 36 can also be seen in FIG. 5, which is an end view taken from the second end 8 (i.e., the "cold" end) of the stack shown in FIG. 3.

Figure 5:
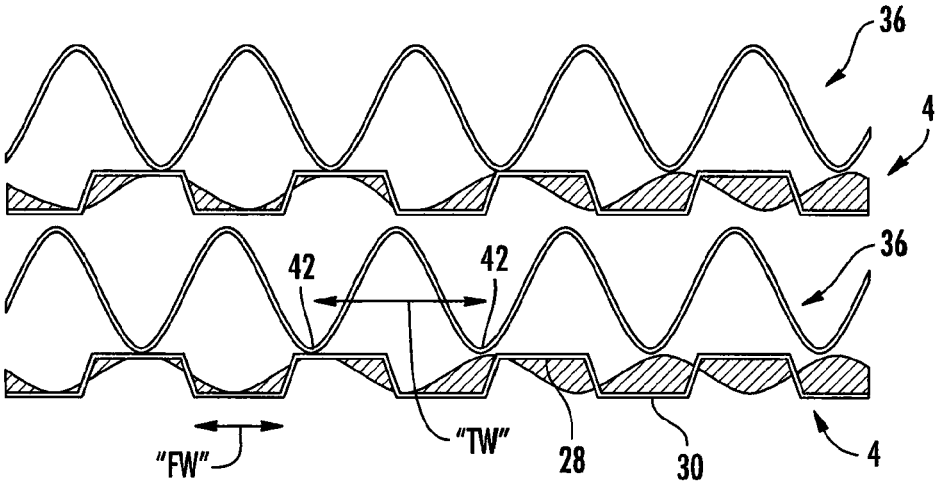
FIG. 5 is an end view of the stack of FIG. 3.
Figure 6:
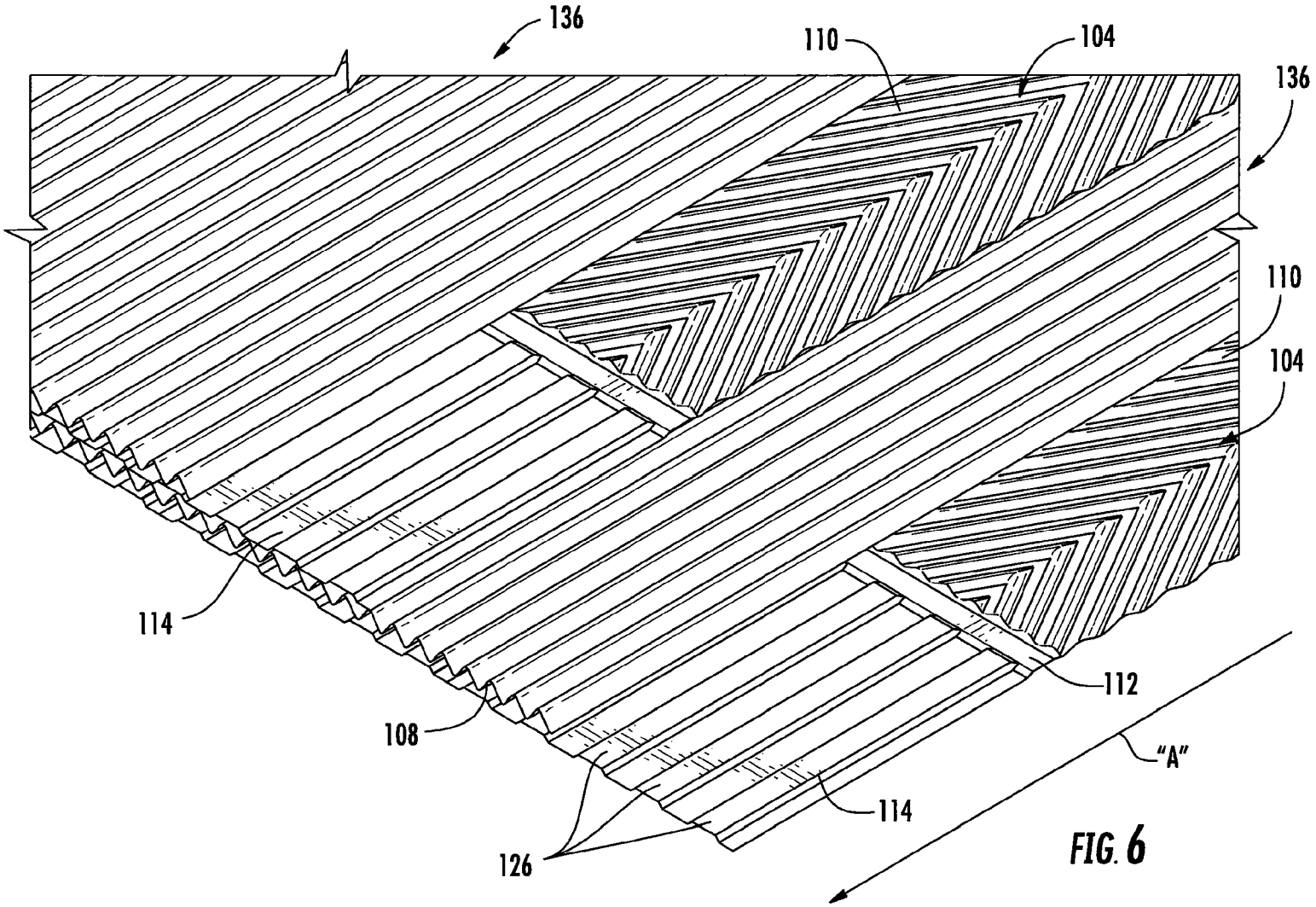
FIG. 6 is an isometric view of an exemplary stack of heat transfer elements including an alternative disclosed heat transfer element.
Figure 7:
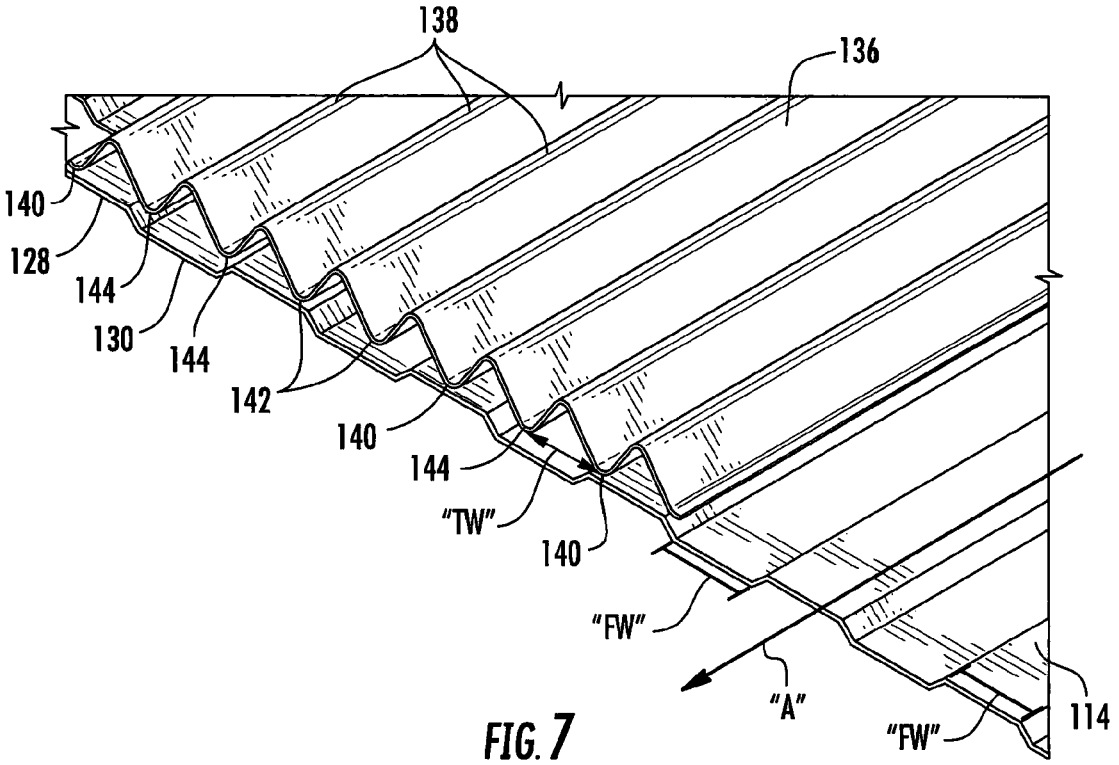
FIG. 7 is a detail isometric view of a portion of the stack of FIG. 6.
Figure 8:
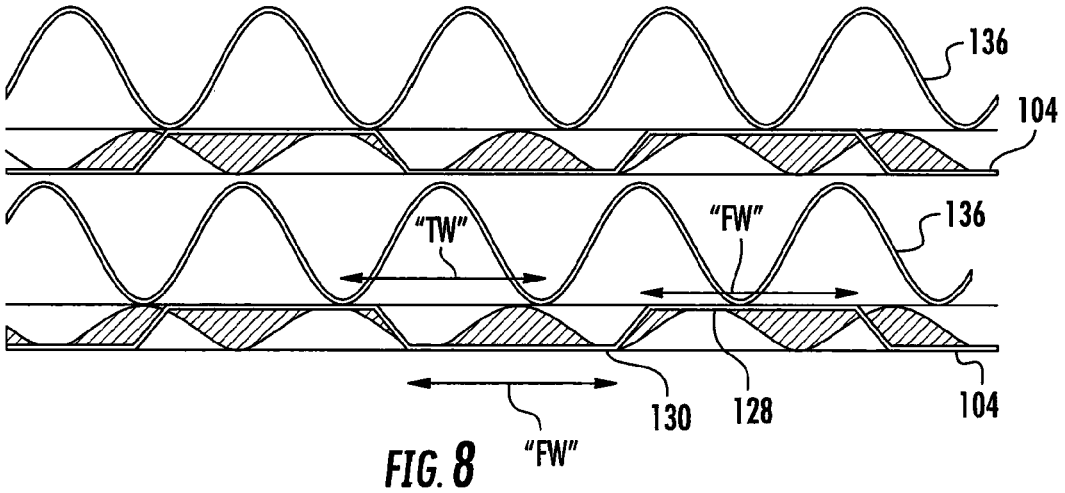
FIG. 8 is an end view of the stack of FIG. 6.

Referring to FIGS. 6-8, an alternative stack arrangement is shown. This embodiment may include first and second heat transfer elements 104, 136 having some or all of the features of the first and second heat transfer elements 4, 36 described in relation of FIGS. 3-5, with the exception that the first heat transfer elements 104 may have a different geometric relationship between profile elements at the second end 108.

Thus, the first heat transfer element 104 may have first, second and third zones 110, 112, 114 aligned sequentially in a primary gas flow direction "A." The first zone 110 may comprise a herringbone profile substantially as previously described. The second zone 112 may comprise a flat "transition zone" and the third zone 114 may comprise a corrugated profile as previously described, including flat peaks 128 and troughs 130.

In this embodiment, however, in the third zone 114 of the first heat transfer element 104 the width "FW" of the flat peaks 128 and troughs 130 may be equal to the distance "TW" between adjacent troughs 142 of the corrugations 138 of the second heat transfer element 136. As can be seen in FIG. 7, in certain places 140, the troughs 142 of the second heat transfer element 136 have good line contact with the flat-topped peaks 128 and troughs 130 of the third zone 114 of the first heat transfer element 104. In other places 144, the troughs 140 of the second heat transfer element have poor or no line contact with the flat-topped peaks 128 and troughs 130 on the third zone 114 of the first heat transfer element 104. The interrelation between the features of the first and second heat transfer elements 104, 136 can also be seen in FIG. 8, which is an end view taken from the second end 8 (i.e., the "cold" end) of the stack shown in FIG. 6.

Figure 9:
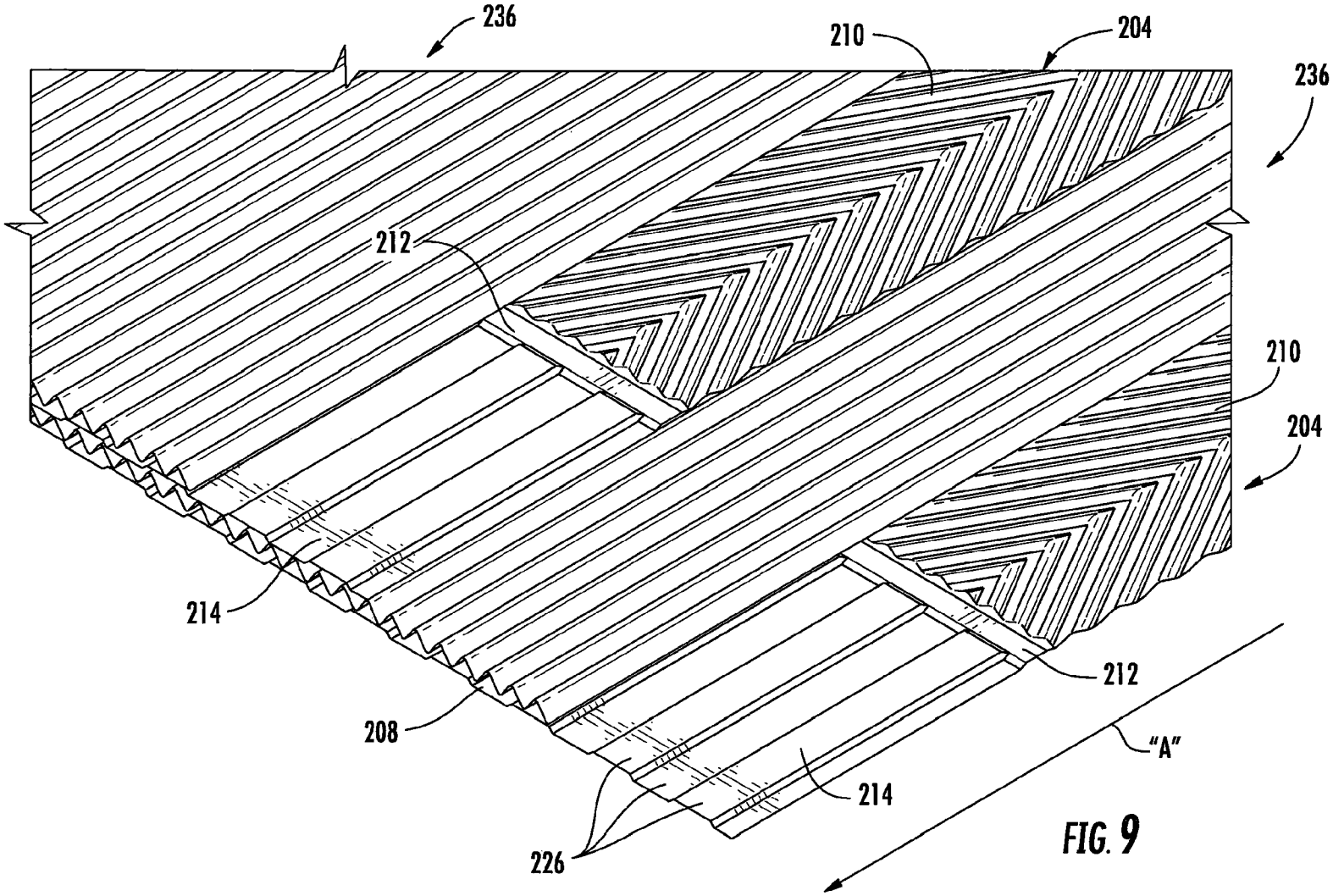
FIG. 9 is an isometric view of an exemplary stack of heat transfer elements including an alternative disclosed heat transfer element.
Figure 10:
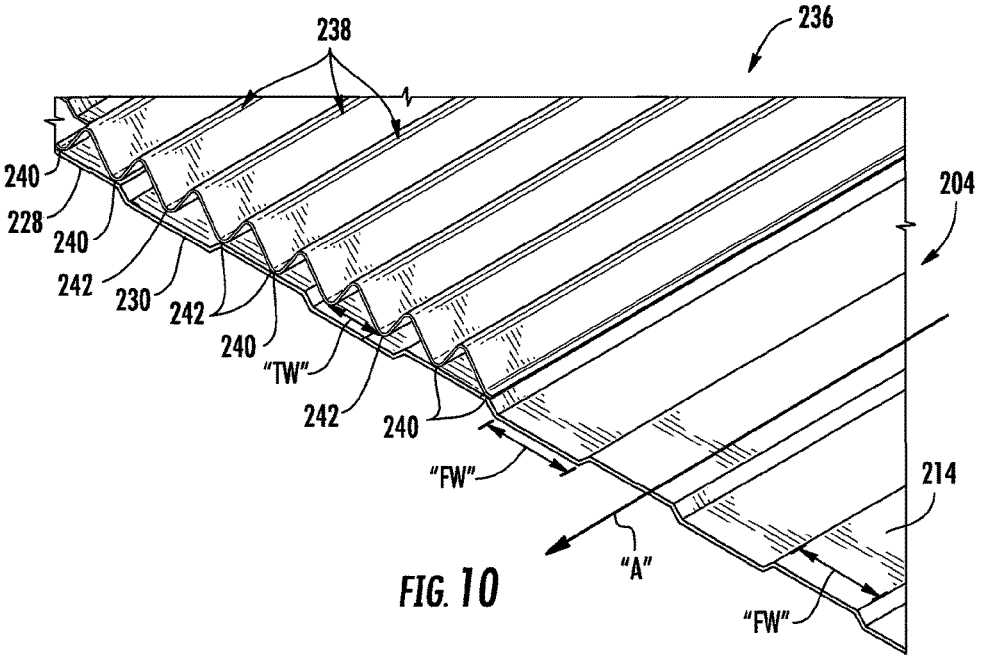
FIG. 10 is a detail isometric view of a portion of the stack of FIG. 9.
Figure 11:
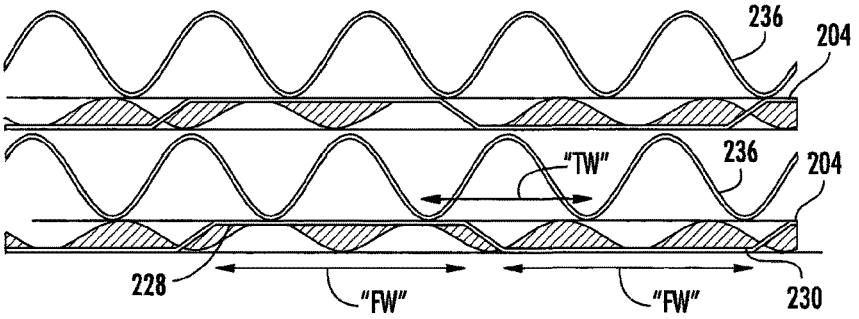
FIG. 11 is an end view of the stack of FIG. 9.

Referring to FIGS. 9-11, a further alternative stack arrangement is shown. This embodiment may include first and second heat transfer elements 204, 236 having some or all of the features of the first and second heat transfer elements 4, 36 described in relation of FIGS. 3-6, with the exception that the first heat transfer elements 204 may have a different geometric relationship between profile elements at the second end 208.

Thus, the first heat transfer element 204 may have first, second and third zones 210, 212, 214 aligned sequentially in a primary gas flow direction "A." The first zone 210 may comprise a herringbone profile substantially as previously described. The second zone 212 may comprise a flat "transition zone" and the third zone 214 may comprise a corrugated profile as previously described, including flat peaks 228 and troughs 230.

In this embodiment, however, in the third zone 214 of the first heat transfer element 204 the width "FW" of the flat peaks 228 and troughs 230 may be equal to 1.5 times the distance "TW" between adjacent troughs 242 of the corrugations 238 of the second heat transfer element 236. As can be seen in FIG. 10, in certain places 240, the troughs 242 of the second heat transfer element 236 have good line contact with the flat-topped peaks 228 and troughs 230 of the third zone 214 of the first heat transfer element 204. In other places 244, the troughs 240 of the second heat transfer element have poor or no line contact with the flat-topped peaks 228 and troughs 230 on the third zone 214 of the first heat transfer element 204. The interrelation between the features of the first and second heat transfer elements 204, 236 can also be seen in FIG. 11, which is an end view taken from the second end 8 (i.e., the "cold" end) of the stack shown in FIG. 9.

Each of the described embodiments illustrate novel heat transfer elements incorporating three separate zones along the depth/height of the elements. The deeper hot end zone 10 of these element sheets 4, which may be about 600 mm deep comprise of undulations arranged in a transverse herringbone arrangement. The main purpose of these transverse herringbones is to restrict skew flow though the elements as the gas flows from hot end 6 to the cold end 8 of the element pack on traverse through the gas side of the rotary air preheater 1 and as the air flows from cold to hot end of the air preheater during the transit of the element basket 2 through the air side of the rotary regenerative air preheater.

As shown in the figures, at the opposite, cold end 8 of the element pack there is a third zone 114 of flat topped undulations that run longitudinally along the depth of the element in the flow direction and typically constitute the lower 300 mm of the element depth—although that dimension can vary.

As can be seen in FIGS. 5, 8 and 11, the height "FTH" of these said flat topped undulations 26, 126, 226 are selected to be the same as the height "HTH" of the transverse herringbone undulations 22, 24 towards the hot end 6 of the heat transfer element 4, 104, 204. Arranged in such a fashion, it can be seen that these flat-topped undulations 26, 126, 226 provide a relatively wide sealing surface against which one or more peaks of the corrugations 38, 138, 238 in the opposing second heat transfer elements 36, 136, 236 compress, thereby forming a line of continuous contact forming closed channels.

The different embodiments show the typical effect of increasing the width "FW" of the flat topped undulations 26, 126, 226 in providing contact between the peaks of the corrugations 36, 136, 236.

The closed channels formed by these lines of contact produce a physically closed element profile that acts to contain both normal gas flow patterns and the intermittent sootblowing jets used for cleaning the elements. Indeed, the combination of this physically closed element at the cold end (e.g., second end 8) of the elements 4, 104, 204, combined with the aerodynamically closed profile produced by the transverse herringbone undulations 22, 24 further up the element act to maximize the penetration the sootblowing jets and increase their cleaning effectiveness.

At the same time, it can be noted that this cold end 8 of the disclosed composite profile (the first heat transfer element 4, 104, 204) does not incorporate any angled undulations to promote turbulence and increase the thermal performance of the element. Therefore, this corrugated-flat section (the third zone 14, 114, 214 of the first heat transfer element 4, 104, 204 produces a zone with low heat transfer and pressure drop characteristics analogous to those of conventional low performance notched-flat elements mentioned earlier.

A much shallower intermediate zone (the second zone 12, 112, 212) of the first heat transfer element 4, positioned between the different hot end (first zone 10, 110, 210) and cold end (third zone 14, 114, 214) profiles of the element. This intermediate zone (the second zone 12, 112, 212) is typically only around 25 mm in length and is deliberately not formed into any determinate shape. Instead, its purpose is to produce a natural, free-form transition between the different profiles (i.e, the transverse herringbone profile of the first zone 10, 110, 210 and the flat topped corrugated profile of the second zone), thereby allowing this transition zone 12, 112, 212 to take up its natural shape in a smooth manner. This transition zone 12, 112, 212 is designed to eliminate any sudden transitions between one profile and another, which sudden steps might otherwise promote enhanced, localized erosion rates. In addition, the uninterrupted continuity across the transition zone 12, 112, 212 also ensures that the reduction in the peak sootblower jet velocities and associated peak impact pressure is minimized, thereby ensuring effective cleaning.

The inventor is unaware of any heat transfer element that has been designed specifically with the purpose of producing with different performance characteristics at each end of the same heat transfer element. The inventor also believes that the castellated, flat topped undulations (peaks 28, 128, 228, troughs 30, 130, 230) which are designed to alternately come into line contact with the corrugations of the opposing element sheets on either side of the undulated sheet is a unique approach to producing closed channel elements. Additionally, the inventor believes that the shallow, non-preformed transition zone 12, 112, 212 provides a novel but simple approach to promoting smooth flow patterns between the different hot and cold ends of the element profile, thereby minimizing the erosion rate and promoting smooth transition of flow from one zone of the element to the other and reducing the intermediate pressure drops and energy losses.

Because it will reduce the inter-tier shocks and losses, the applicant also argues that this invention should produce a lower pressure drop than the more traditional two tier arrangement.

Several alternative structure arrangements that might be incorporated without changing the basic invention have been described, in which the width "FW" of the flat topped undulations (peaks 28, 128, 228, troughs 30, 130, 230) has been varied showing typical arrangements that produce a minimum of one to two lines of contact against single flat topped undulations and, similarly, no more than one to two lines of corrugations at the cold end (the third zone 12) of the first heat transfer element 4 where there is no contact between these corrugations and the adjacent troughs 30, 130, 230 of the flat-topped undulations. It is considered desirable to achieve these constraints in order to maximize the stability of the finally compressed element pack.

It will be appreciated that the disclosed arrangement can be used in a variety of types of heat exchangers, such as plate type heat exchangers, to produce the same combination of benefits as described in relation to the rotary regenerative heat exchanger 1 described herein.

While the present invention has been disclosed with reference to certain embodiments, numerous modifications, alterations and changes to the described embodiments are possible without departing from the spirit and scope of the invention, as defined in the appended claims. Accordingly, it is intended that the present invention not be limited to the described embodiments, but that it has the full scope defined by the language of the following claims, and equivalents thereof.

What is claimed is:

1. A stack of heat transfer elements with a primary gas flow direction, said stack comprising:

a first heat transfer element having zones arranged sequentially along the primary gas flow direction, a first zone disposed proximate to a first end of the stack of heat transfer elements, the first zone including a herringbone structure, the herringbone structure having a plurality of undulations arranged laterally side by side, a longitudinal extent of said plurality of undulations being non-parallel to said primary gas flow direction; and a second zone disposed proximate to a second end of the stack of heat transfer elements, the second zone including a plurality of castellated corrugations extending in the primary gas flow direction, the plurality of castellated corrugations having a series of repeated and adjacent flat peaks and troughs; and a second heat transfer element, said second heat transfer element including a plurality of undulating corrugations extending in the primary gas flow direction, said plurality of undulating corrugations having a different structure from said plurality of castellated corrogations, wherein the first heat transfer element is disposed over the second heat transfer element in the stack, such that the plurality of castellated corrugations of the first heat transfer element are configured to contact the plurality of undulating corrugations of the second heat transfer element along the primary gas flow direction.

2. The stack of claim 1, wherein the herringbone structure comprises a first region having a plurality of undulations arranged laterally side by side, a longitudinal extent of said plurality of undulations in said first region being greater than 0° and less than 90° to said primary gas flow direction, said herringbone structure further comprising a second region, adjacent to said first region, said second region having a plurality of undulations arranged laterally side by side, a longitudinal extent of said plurality of undulations in said second region being less than 0° and more than −90° to said primary gas flow direction.

3. The stack of claim 1, wherein a width of each of the flat peaks and troughs of the first heat transfer element is from 0.5 to 1.5 times a distance between adjacent troughs of said undulating corrugations of said second heat transfer element.

4. The stack of claim 1, wherein said stack comprises a plurality of first heat transfer elements and a plurality of second heat transfer elements, each first heat transfer element being adjacent to at least one of said second heat transfer elements.

5. The stack of claim 1, further comprising a third zone disposed between said first zone and said second zone, wherein the third zone includes a flat structure.

6. The stack of claim 1, wherein the contact of the plurality of castellated corrugations of the first heat transfer element with the plurality of undulating corrugations of the second heat transfer element along the primary gas flow direction creates closed channels.

7. The stack of claim 1, wherein a height of the plurality of castellated corrugations of the first heat transfer element is equal to a height of the plurality of undulations in the herringbone structure of the first heat transfer element, such that in the stack, continuous contact between the stacked first and second heat transfer elements forms closed channels.

8. The stack of claim 7, wherein the third zone comprises a first transition region adjacent said first zone, the first transition region comprising a shape that transitions between said plurality of undulations of said herringbone structure of said first zone and said flat structure of said third zone.

9. The stack of claim 8, wherein the third zone comprises a second transition region adjacent said second zone, the second transition region comprising a shape that transitions between said flat structure of said third zone and said plurality of castellated corrugations of said second zone.

10. A stack of heating surface elements with a primary gas flow direction, said stack comprising:

a first heating surface element having zones arranged sequentially along the primary gas flow direction, a first zone disposed proximate to a first end of the stack of heating surface elements, the first zone including a herringbone structure, said herringbone structure having a plurality of regions, said plurality of regions being arranged such that a boundary of regions is along said primary gas flow direction, said plurality of regions including a first region having a plurality of undulations arranged laterally side by side, a longitudinal extent of said plurality of undulations in said first region being greater than 0° and less than 90° to said primary gas flow direction, said plurality of undulating corrugations having a different strucutre from said plurality of castellated corrugations, said plurality of regions further including a second region, adjacent to said first region, said second region having a plurality of undulations arranged laterally side by side, a longitudinal extent of said plurality of undulations in said second region being less than 0° and more than −90° to said primary gas flow direction; and a second zone disposed proximate to a second end of the stack of heating surface elements, the second zone including a plurality of castellated corrugations extending in the primary gas flow direction, said plurality of undulating corrugations having a differnt structure from said plurality of castellated corrugations, the castellated corrugations having a series of repeated and adjacent flat peak and trough regions; and a second heating surface element, said second heating surface element including a plurality of undulating corrugations extending in the primary gas flow direction, said plurality of undulating corrugations having a different structure from said plurality of castellated corrogations, wherein the first heating surface element is disposed over the second heating surface element in the stack, such that the plurality of castellated corrugations of the first heating surface element are configured to contact the plurality of undulating corrugations of the second heating surface element along the primary gas flow direction.

11. The stack of claim 10, wherein a width of each of the flat peaks and troughs of the first heating surface element is from 0.5 to 1.5 times a distance between adjacent troughs of said undulating corrugations of said second heating surface element.

12. The stack of claim 7, wherein said stack comprises a plurality of first heat transfer elements and a plurality of second heat transfer elements, each first heat transfer element being adjacent to at least one of said second heat transfer elements.

13. The stack of claim 10, further comprising a third zone disposed between said first zone and said second zone, wherein the third zone includes a flat structure.

14. The stack of claim 13, wherein the third zone comprises a first transition region adjacent said first zone, the first transition region comprising a shape that transitions between said plurality of undulations of said herringbone structure of said first zone and said flat structure of said third zone.

15. The stack of claim 14, wherein the third zone comprises a second transition region adjacent said second zone, the second transition region comprising a shape that transitions between said flat structure of said third zone and said plurality of castellated corrugations of said second zone.

16. A stack of heating surface elements with a primary gas flow direction, said stack comprising:

a first heating surface element having zones arranged sequentially along the primary gas flow direction, a first zone disposed proximate to a first end of the stack of heating surface elements, the first zone including a herringbone structure, and a second zone disposed proximate to a second end of the stack of heating surface elements, the second zone including a plurality of castellated corrugations extending in the primary gas flow direction, the castellated corrugations having a series of repeated and adjacent flat peak and trough regions; and a second heating surface element, said second heating surface element including a plurality of undulating corrugations extending in the primary gas flow direction, said plurality of undulating corrugations having a different structure from said plurality of castellated corrogations, wherein the first heating surface element is disposed over the second heating surface element in the stack, such that the plurality of castellated corrugations of the first heating surface element are configured to contact the plurality of undulating corrugations of the second heating surface element along the primary gas flow direction.

17. The stack of claim 16, wherein a width of each of the flat peaks and troughs of the first heating surface element is from 0.5 to 1.5 times a distance between adjacent troughs of said undulating corrugations of said second heating surface element.

18. The stack of claim 16, further comprising a third zone disposed between said first zone and said second zone, wherein the third zone includes a flat structure.

19. The stack of claim 18, wherein the third zone comprises a first transition region adjacent said first zone, the first transition region comprising a shape that transitions between said plurality of undulations of said herringbone structure of said first zone and said flat structure of said third zone.

20. The stack of claim 19, wherein the third zone comprises a second transition region adjacent said second zone, the second transition region comprising a shape that transitions between said flat structure of said third zone and said plurality of castellated corrugations of said second zone.

* * * * *